United States Patent [19]

Raubenheimer

[11] 4,358,047

[45] Nov. 9, 1982

[54] CARTON DIVIDER

[75] Inventor: Wallace O. Raubenheimer, New Paltz, N.Y.

[73] Assignee: Jefferson Smurfit Incorporated, Alton, Ill.

[21] Appl. No.: 241,477

[22] Filed: Mar. 9, 1981

[51] Int. Cl.[3] ..... B65D 5/48

[52] U.S. Cl. ..... 229/15; 229/42; 217/32

[58] Field of Search ..... 229/15, 42; 217/31, 217/32, 33

[56] References Cited

U.S. PATENT DOCUMENTS

| | | | |
|---|---|---|---|
| 456,353 | 7/1891 | Bower | 217/32 |
| 606,913 | 7/1898 | Bower | 217/32 |
| 2,175,670 | 10/1939 | Rutledge | 217/32 |
| 2,677,491 | 5/1954 | Burger | 217/32 |
| 2,920,782 | 1/1960 | Buttur | 229/15 |
| 4,103,818 | 8/1978 | Raubenheimer | 229/15 |
| 4,194,675 | 3/1980 | Riters | 217/32 |

*Primary Examiner*—Herbert F. Ross
*Attorney, Agent, or Firm*—Brooks, Haidt, Haffner & Delahunty

[57] ABSTRACT

A bottle-carton divider is formed by interlocking partitions each having a laterally projecting tab located along the length of, and extending into the half-height vertical slot of the partition by which the interlock with a cross-partition is effected. A tab-receiving opening is formed in each partition having an edge at a location spaced below but in alignment with an edge of the vertical slot. When the divider is assembled, the locking tab on any partition engages and overlaps the referred to edge of the tab-receiving opening of the interlocking partition, producing a pair of oppositely-directed abutment interfaces which restrain the locking tabs against disengagement in both directions, and in both the opened condition and one of the two possible collapsed conditions of the divider. The locking effect is enhanced and maintained by an additional edge or holding point at the bottom of each partition slot, facing but spaced away from the line of the opposite slot wall a distance equal to the thickness of the interlocking partition. Directly opposite, a cutaway of the opposite slot wall facilitates cutting and assembly of the partitions. Further, a laterally projecting partition support tab, adjacent to the open end of each partition slot, provides a second holding point for the interlocked partition, and the tab-receiving opening includes a seating edge extending perpendicularly to the slot axis and an arcuate portion at its opposite corner, which provide more firm engagement of the engaged locking tab.

12 Claims, 7 Drawing Figures

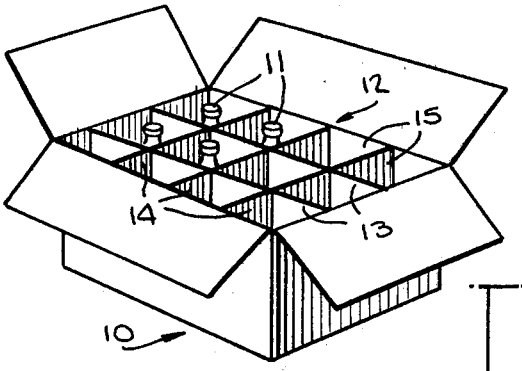
Fig. 1.
Fig. 7.
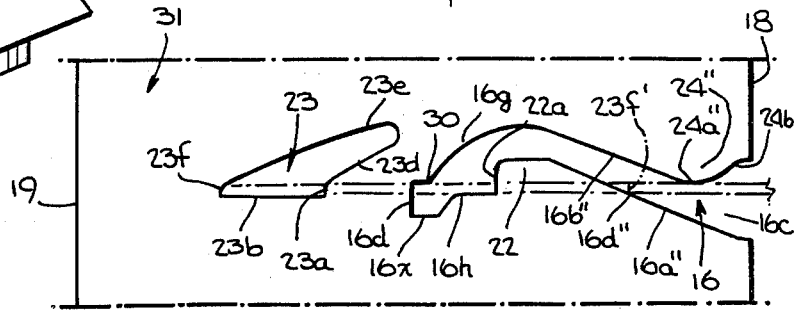
Fig. 5.
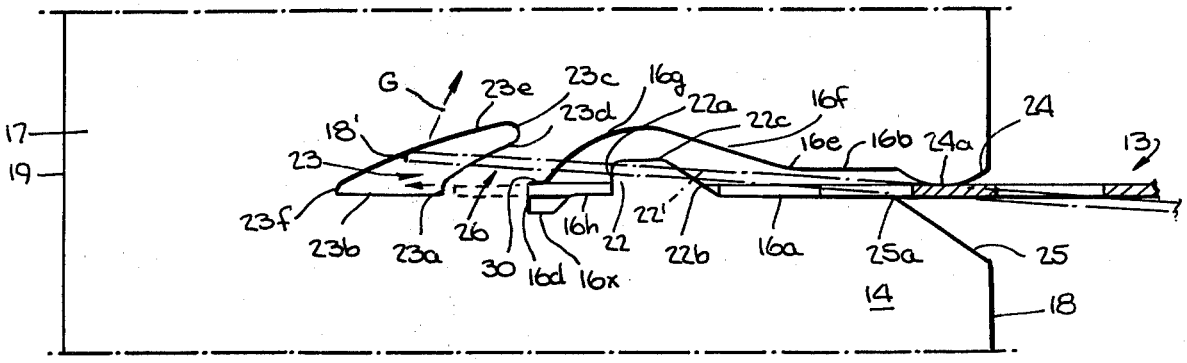
Fig. 6.
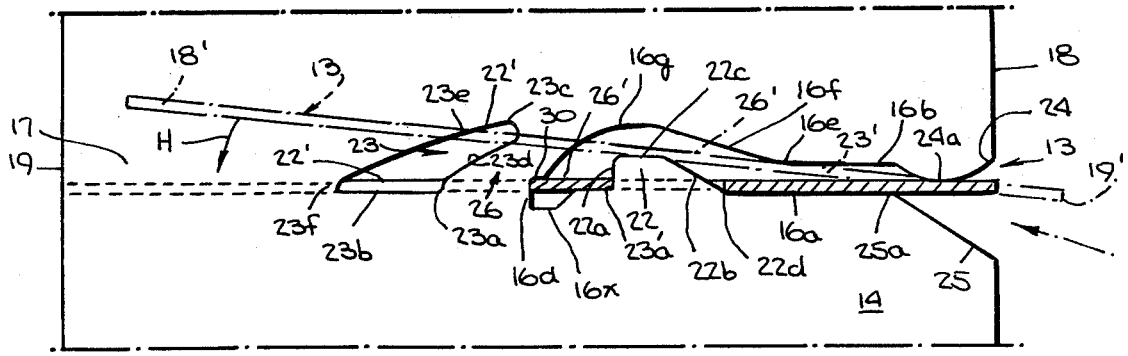

CARTON DIVIDER

FIELD OF THE INVENTION

This invention relates to collapsible space dividers for containers such as cartons in which a quantity of bottles or the like are packed and shipped. More particularly, the invention relates to means which improve the interlock between the respective intersecting longitudinal and transverse partitions which form the divider, providing an enhanced locking effect to both its open and collapsed conditions.

BACKGROUND OF THE INVENTION AND THE PRIOR ART

Although it may have uses in other dividers, the invention constitutes an improvement of the carton divider disclosed in U.S. Pat. No. 4,103,818 (Raubenheimer), and therefor will be described in connection with such use.

The inadequacies of prior carton dividers and the improvement contributed by that invention are adequately described in that U.S. Pat. No. 4,103,818, whose specification is incorporated by reference in the present specification. Briefly, that invention provides a carton divider whose partitions and cross partitions are slotted in a particular manner so that they will interlock fairly rigidly with each other when the divider is collapsed in one direction as well as when the divider is open and erected. Yet, when the divider is collapsed in the opposite direction, its partitions and cross partitions readily disengage from each other so that one or more of the partitions may be easily removed and replaced, if necessary.

In that invention the interlock between each longitudinal and transverse partition is provided at the intersecting slot connection by respective tabs which are formed on each of the partitions and project laterally across the imaginary axis of the connection slot of each partition and which respectively engage a tab-receiving opening formed in the interconnected partition. When the partitions are interlocked, an edge of each tab is in abutting engagement with an oppositely facing edge of the tab-receiving cutout in the adjacent partition. Thus, there are two vertically spaced apart and oppositely directed abutment interfaces along the length of the connection to prevent disengagement movement of the partitions in either direction along the line of their intersection.

In the preferred embodiment of that invention a partition support tab, located adjacent to the open end of the slot in each partition and projecting laterally part way across the slot, promotes rigidity in the erected divider by holding each interlocking partition against the opposite side of the slot. The snug-fit engagement of the locking tab within the tab-receiving opening of the interlocked partition holds the latter firmly in the same direction below its midpoint, thus rigidly maintaining the interlock.

When the thus assemblied divider is collapsed in one direction with its interlocked partition extending parallel and adjacent to one another, the tab on each partition continues to project through the tab-receiving opening of the other partition and overlaps an edge of the opening which lies along the imaginary axis of the connection. Thus, the invention contained in that patent is characterized by the overlapped condition of each tab with respect to its adjacent, interlocked partition when the divider is collapsed in one direction, and the appearance on the same side of the collapsed divider of both of the oppositely directed tabs in any such pair thereof. When the assembled divider is collapsed in the reverse direction the tab interlock is not maintained, and the partitions can be easily separated. Thus, the assembled divider can be easily disassembled by simply reversing the direction of collapse of the divider.

Because of the novel interlocking arrangement, considerable rigidity of the divider in its assembled condition is attained regardless of the width of the interlock slot of each partition. Thus, the slot width is made relatively wide as compared with the thickness of each partition, for ease of assembly, yet a rigid interlock is achieved.

The present invention is intended to still further improve the interlock both in the erected condition and in the collapsed condition.

SUMMARY OF THE INVENTION

Briefly describing the present invention in its preferred embodiment and with reference to any interlocked pair of partitions in the previously described divider shown in U.S. Pat. No. 4,103,818, the locking effect is enhanced and its rigidity is better maintained by modifying the shaped at the bottom of each partition slot to include an additional edge or, more accurately, a holding point which engages and holds the intersecting partition firmly, the holding point facing in direction towards the opposite slot wall, against which the intersecting partition normally rests. This holding or "pressure" point is spaced away from the line of the opposite slot wall a distance which is equal to the thickness of the interlocking partition, to ensure an exact and rigid fit. However, such exactness of size and fit would be difficult to achieve during the cutting and assembling processes were it not for a cutaway or relief, which is also provided by the present invention, in the opposite slot wall at the location therealong which is directly across from the referred to holding point or edge, as will be seen.

Each partition further includes a partition support tab projecting laterally part way into the partition slot adjacent to its open end, and on the same side of the slot as the aforementioned holding point, to provide a second holding point, at or near the open end of the slot and spaced away from the first-mentioned holding point, to engage and hold the cross-partition vertically and firmly against the same opposite edge portion of the slot. Thus, two holding points or edge portions on one side of the slot hold the cross-partition against at least one vertical edge portion on the opposite side of the slot. However, in the preferred embodiment, there are two edge portions along the opposite slot edge against which the cross-partition is held, as will be seen.

In addition, the invention in its preferred embodiment provides a seating edge within the tab-receiving opening of each partition, perpendicular to the axis of connection of the slots, which the engaging bite edge of the locking tab of the intersecting cross-partition engages more firmly than as shown in the aforementioned U.S. Pat. No. 4,103,818, thus further enhancing the rigidity of the interlock. The length of this seating edge is only equal to the thickness of the cross-partition, but its perpendicular or transverse disposition with respect to the slot axis provides a more accurate "land" for the locking tab of the intersecting partition as it achieves its intended position of engagement in the tab-receiving opening during assembly of the divider.

It will be noted that the particular shape and width of each partition slot is not critical, except for the positioning of the aforementioned holding or pressure edges or points along its length, and, when included, the positioning of the transversely disposed seating edge of the tab-receiving opening which will be engaged by the locking tab of the interlocking partition. As a consequence, the side edges of each partition slot towards its open end may be spaced widely apart, and may even extend in tapered fashion towards each other, to allow for less accuracy in the relative positioning of the partition parts as they are brought together to be joined, which results in faster assembly of the divider.

DETAILED DESCRIPTION OF PREFERRED EMBODIMENTS

These and other objects, features and advantages of the invention will be apparent from the following detailed description thereof, in which reference will be made to the accompanying drawings. In the drawings:

FIG. 1 is a perspective view of a carton partly filled with bottles or the like, and having a carton divider in accordance with the invention inserted therein to form respective cells for the individual bottles;

FIGS. 5 and 6 are enlarged fragmentary side views which, together, show the progression of engagement of one partition with another as they interlock together when assembling a carton divider in accordance with the invention; and FIG. 7 is a fragmentary plan view of only the slot and cutout portions of a modified form of partition for assembling a carton divider in accordance with the invention.

Figure 2:
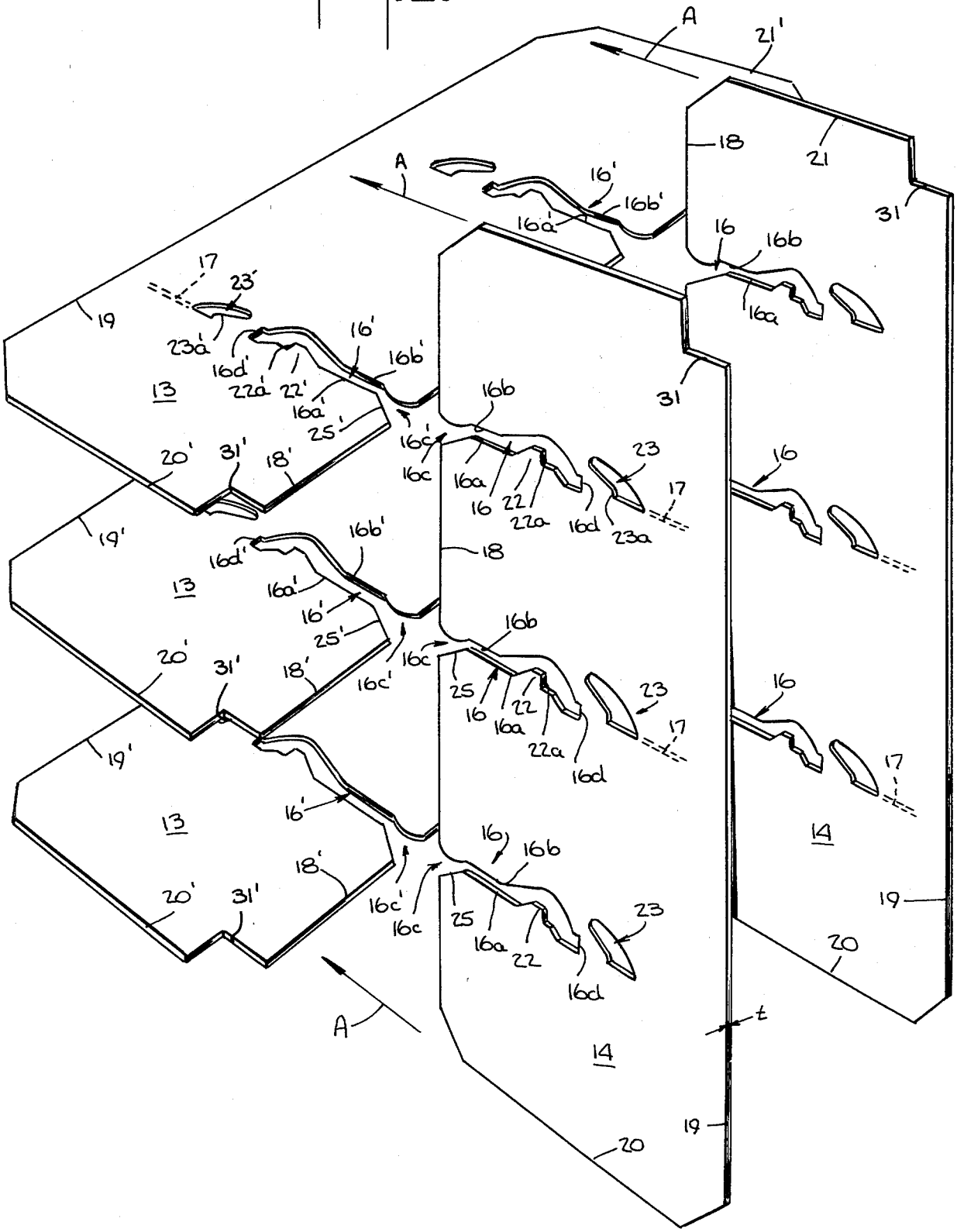
FIG. 2 is an enlarged perspective showing of several longitudinal and transverse partitions about to be assembled to form a carton divider in accordance with the invention.

Referring to FIG. 1, a corrugated cardboard carton 10, for packing and shipping a dozen glass or plastic bottles 11 (only four of which are shown), has a carton divider therein which is made in accordance with the invention and is generally indicated by reference numeral 12. The divider 12, whose two longitudinal partition parts 13 and three transverse or cross partition parts 14 are made of chipboard, divides the interior space of the carton 10 into a number of bottle cells 15, in this case one dozen, for respectively receiving and protecting the individual bottles 11 during shipping and rough handling. In the illustrated embodiment, the carton divider 12 is a full-height divider, i.e., its height is equal to that of the bottles 11 or carton 10, but it will be understood that a divider 12 in accordance with the invention may be made greater or less than full-height in particular applications, as is conventional.

Although FIG. 1 illustrates a divider 12 in accordance with the invention which has two longitudinal partitions 14 and three transverse or cross-partitions 13, it will also be understood that the invention is effective for conjoining only two partitions in criss-cross fashion, such as a pair of equal-length partitions which are interlocked centrally of their respective lengths to form a 4-cell divider for a carton intended to hold only four bottles. Of course, dividers having a great many more longitudinal and transverse partitions for providing, say, several dozen cells in a carton in which many small bottles will be packed, may also be made in accordance with the invention.

The separate partition parts 13 and 14 (hereinafter referred to simply as "partitions") which are assembled to form the carton divider 12, and the manner of their assembly, is more clearly illustrated in FIG. 2. That is, using a conventional carton divider assembly machine (sometimes called a "partition assembly machine"), the three transverse partitions 13 are somewhat loosely held by the machine (not shown) in a parallel, equally spaced apart position relative to each other as illustrated, whereupon the two orthogonally held, equally spaced apart longitudinal partitions 14, appropriately positioned as shown, are moved forwardly, in the direction of the arrows A, so that their open-ended slots 16 are moved into the corresponding oppositely directed open-ended slots 16' of the partitions 13. (Although the parts are identical in shape and size, for clarity of understanding, the corresponding elements of the partitions 13 have been given a prime (') designation in the drawings, and will be so indicated where necessary in the following description.) The partitions 14 are moved by the machine into interlocking engagement with the partitions 13.

In the embodiment shown in FIGS. 2–6, the erect disposition of the interlock between the partitions 13 and 14 at any slot connection is by engagement of the slot side edge portion **16*a* (or 16*a'*) with the surface portion 17 (or 17') of the cross-partition; and of the slot side edge portion 16*h* (or 16*h'*) with the surface portion 26' (or 26) of the cross-partition; and of the tab receiving opening edge 23*b* (or 23*b'*) with the cross-partition surface portion provided by its projecting tab 22' (or 22); and by the oppositely facing holding points or edge portions 24*a* and 30*a* (or 24*a'* and 30*a'*), as provided respectively by the partition support tab 24 (or 24') adjacent to the open end 16*c* (or 16*c'*) of the slot 16 and by the reversed arcuate portion 30 (or 30') at the slot closed end 16*d* (or 16*d'*), with their respectively cofacing surfaces 26'' (or 26) and 17' (or 17) of the cross-partition, as will be explained in greater detail. The surface portion 17 or 17' of any partition is only that area which is generally in alignment with its slot 16 or 16'. Thus, the partitions 13 and 14 are fully inserted and joined together with all of the first side edges 18, 18' of one group of partitions aligned with all of the second side edges 19', 19, respectively, of the group of cross-partitions, in the manner illustrated in FIG. 3**.

Figure 4:
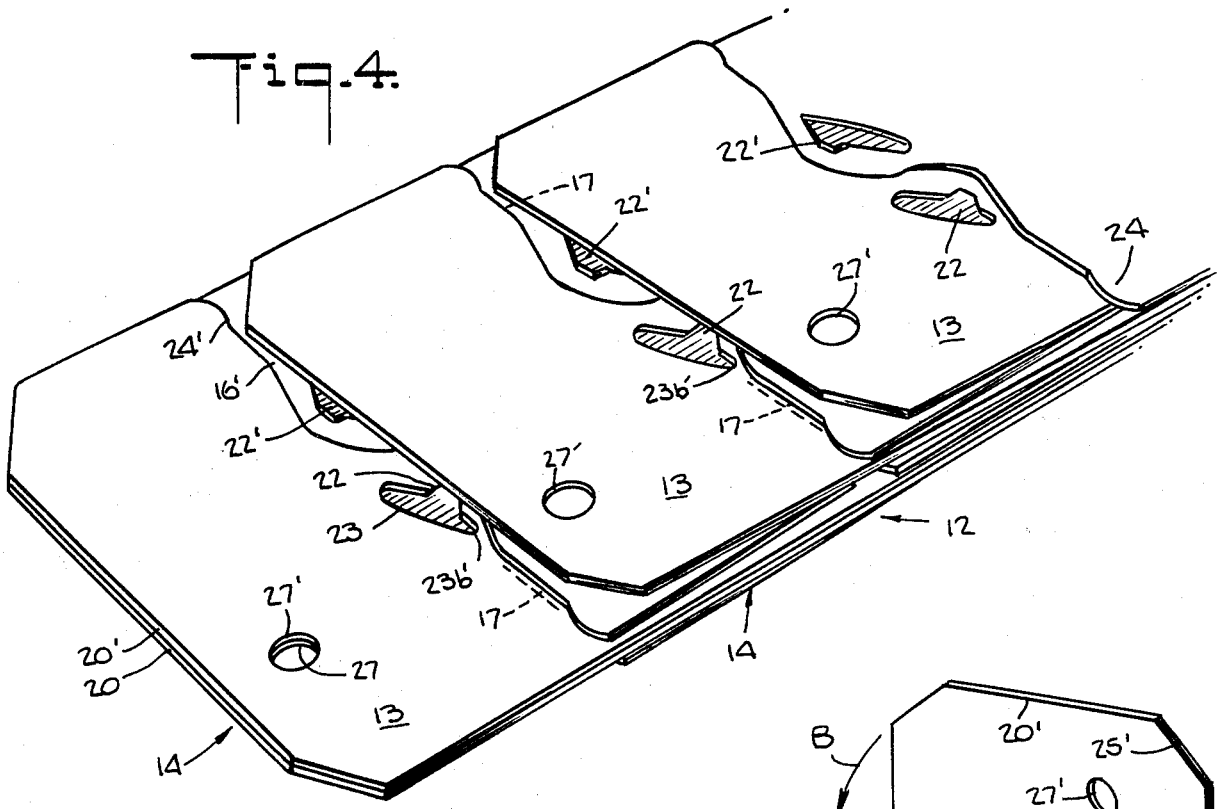
FIG. 4 is a perspective showing of the assembled divider when collapsed in one direction, in which the interlock is retained.
Figure 3:
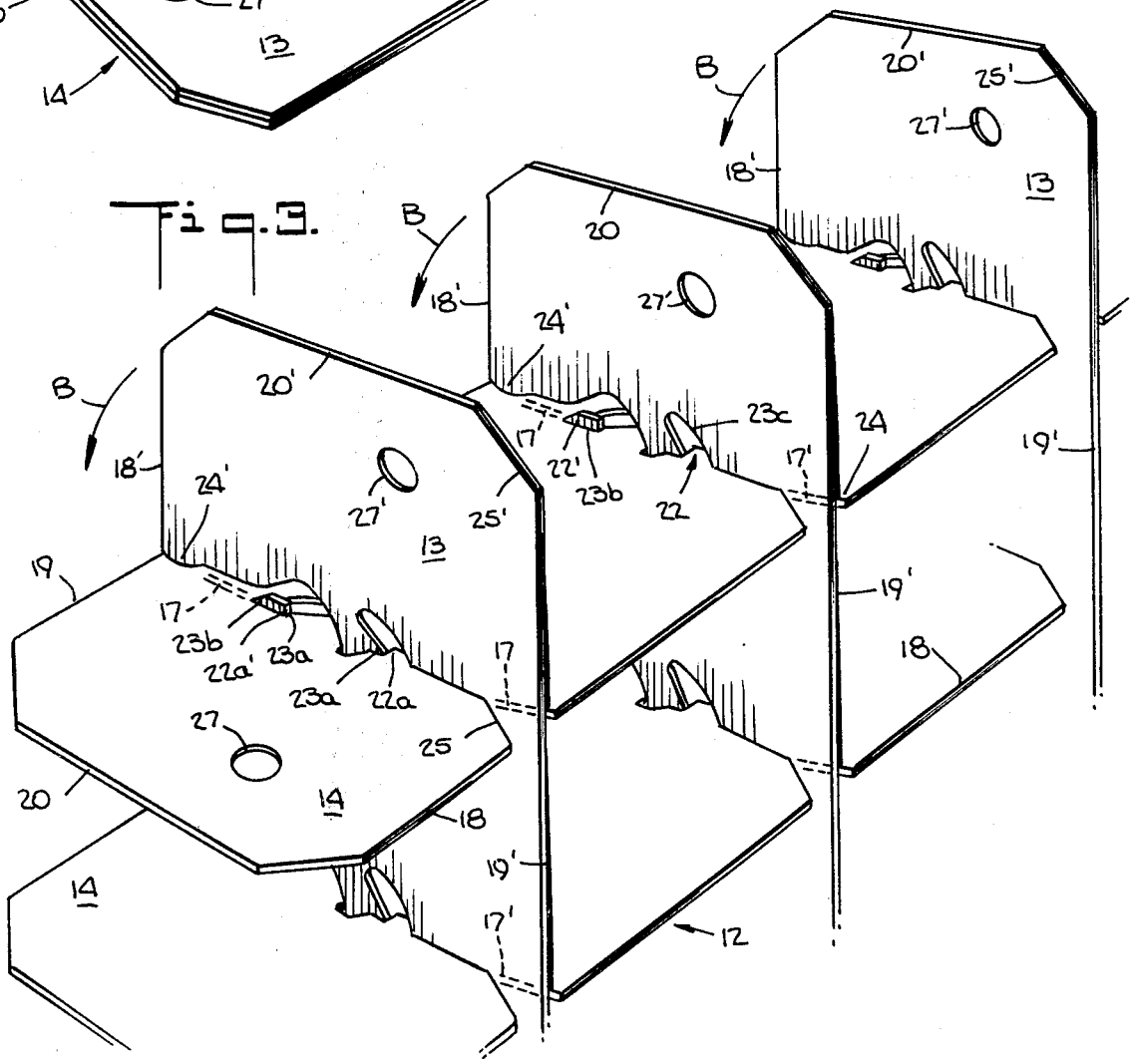
FIG. 3 is a perspective showing of the assembled carton divider as it appears in its opened or erected condition.

As will be understood from a comparison of FIGS. 3 and 4, the assembled carton divider 12 can be collapsed laterally, in the direction of the arrow B in FIG. 3, from its opened or erected condition as seen in FIG. 3 in which the longitudinal and transverse partitions 13, 14 are disposed at right-angles to each other, to a collapsed condition as seen in FIG. 4 in which the partitions 13 and 14 are parallel and lie adjacent to each other. During the collapsing and opening of the divider its longitudinal and transverse partitions pivot with respect to each other about the respective imaginary lines of intersection between their planes, which imaginary lines are also indicated by dotted lines 17 and 17' in FIGS. 3 and 4.

The collapsed dividers as seen in FIG. 4 may be stacked on each other for transporting to and loading in a carton divider inserting machine (not shown) from which they are automatically dispensed one at a time from the bottom of the stack, and then automatically erected using air suction cup apparatus (not shown) and inserted into respective bottle cartons which pass through the machine.

If the partition elements 13 and 14 are not securely interlocked with each other, there is a likelihood that any given divider 12 may become wholly or partly disassembled, and such separation of the partition elements is more likely when the divider is in its collapsed condition. Thus, as previously mentioned and as now will be described in detail, the present invention provides a partition slot configuration which is effective to securely interlock the intersecting partitions while the divider is in its collapsed condition, as well as while it is in its opened or erected condition.

With reference to the transverse and longitudinal partitions 13 and 14 as each is seen in its entirety for example in FIG. 2, it will first be noted that the slot configurations and interlocking elements of all the partitions are the same. Of course, such is an advantage in terms of uniformity of manufacture of all of the partitions regardless of their lengths, and convenience of assembly especially when cross-partitions of the same length are being assembled to make the dividers 12.

Each of the planar partitions 14 and 13 as seen in FIG. 2 has a plurality of cross-partition engagement slots 16, 16' which extend generally parallel to the opposite end edges 20, 20' and 21, 21' of the respective partitions at equally spaced apart locations along the length of the partition. The spacing apart of the slots 16 and 16' determines the size of each bottle cell 15 (FIG. 1), as will be apparent.

With reference to either partition 14 or 13, the generally parallel opposite side edges 16*a*, 16*b* (or 16', 16*b'*) of each slot 16 (or 16') extend inwardly from the open end of the slot, generally indicated by numeral 16*c* (or 16*c'*) at the first edge 18 (or 18') of the partition, to a closed end 16*d* (or 16*d'*) of the slot at an intermediate location across the width of the partition as shown. As will also be apparent, any two cross-partitions 13 and 14 are assembled and interlocked by, for example, moving the open end 16*c* of a slot 16 (or 16') of one of them into the oppositely extending slot 16' (or 16) of the other, the width of each slot between its edges 16*a*, 16*b* (or 16*a'*, 16*b'*) being adequate to receive the thickness t (FIG. 2) of the cross-partition.

The two partitions 13 and 14 are so moved together to the fullest possible extent so that, when fully engaged with each other, the edge provided by the closed end 16*d* (or 16*d'*) of one will normally abut the edge provided by the closed end 16*d'* (or 16*d*) of the other. The coming into abutment of these oppositely facing end edges 16*d* (16*d'*) determines the depth of engagement of either partition with respect to the other. Although here shown as being at the midpoint of each partition, the location of such engagement may be at another location within the width of either or both partitions in the manner shown, for example, in U.S. Pat. No. 2,920,782 (Butters) in which the respective partitions extend only partly into each other so that their respective upper and lower edges do not lie in the same planes with those edges of the cross-partitions.

At an intermediate location along the length of each slot edge 16*a* (or 16*a'*) a locking tab 22 (or 22') projects laterally into the path of the slot 16 (or 16') to provide an abutment edge 22*a* (or 22*a'*) which faces away from the slot open end 16*c* (or 16*c'*), i.e., in the direction opposite to that of the abutment edge provided by the slot closed end 16*d* (or 16*d'*). Preferably, and as shown, this abutment edge 22*a* (or 22*a'*) projects perpendicularly with respect to the slot edge 16*a* (or 16*a'*).

When any two cross-partitions such as the partitions 13 and 14 are interlocked, each locking tab 22 (or 22') will be received in a tab-receiving opening 23' (or 23) of the other partition, and its abutment edge 22*a* (or 22*a'*) will be in engagement with an abutment edge 23*a'* (or 23*a*) which is provided by such opening, as best understood by comparing FIGS. 2 and 3. It will be noted that, with respect to any partition slot 16 (or 16'), the edge 23*a*, 23*a'* also faces away from the open end 16*c*, 16*c'* of the slot, as does the tab edge 22*a*, 22*a'*. Thus, and with particular reference to FIG. 3, it will be noted that this engagement between the two oppositely facing edges 23*a'*, 23*a* of the openings 23, 23' when any two cross-partitions are interlocked, provides a pair of oppositely directed abutment edge interfaces, at spaced apart locations along the imaginary line 17, 17' of their intersection, which substantially prevents disengagement of the interlocked partitions. That is, neither partition is easily moved with respect to the other in either direction along the line of intersection between them. In the preferred embodiments as seen in the drawings, particularly FIGS. 5, 6 and 7, the abutment edges 23*a*, 23*a'* are straight, and extend perpendicular to the slot axes 17, 17' of their respective partitions, thus to provide a pronounced "land" for the tab abutment edge 22*a'* or 22*a* of the interlocking partition as the latter achieves its seating or abutting engagement therewith during assembly of the partitions. Preferably, the length of this "land" is at least eqaul to the partition thickness.

In addition, to hold the tab 22 (or 22') tightly within the tab opening 23' (or 23), a third abutment edge 23*f* (or 23*f'*), facing the abutment edge 23*a*, is provided to engage the tab sloping edge 22*b'* (or 22*b*) of the interlocked partition. The abutment edge 23*f* (or 23*f'*) is preferably formed by a sharp intersection between the tab opening edge 23*e* (or 23*e'*) and the edge 23*b*, but, to accommodate manufacturing limitations, in the embodiment illustrated in FIGS. 5, 6, and 7, the abutment edge 23*f* (or 23*f'*) is an arcuate portion of the tab opening edge 23*e* (or 23*e'*) which curves inwardly, on as small a radius as practical, towards a perpendicular relation with the tab opening edge 23*b* (or 23*b'*). The distance between this edge 23*f* and the slot closed end 16*d* should be equal to the height of the tab 22, along the line of the intersecting partition, plus the height of the tab abutment edge 22 above the slot closed end 16*d*, and should be closely held.

By reason of the straight edges 23*b*, 23*b'* formed by the respective tab-receiving openings 23, 23' of the two partitions, this two-directional interlock is maintained even when the divider 12 is in its collapsed condition as shown in FIG. 4. That is, the straight edges 23*b* and 23*b'* are respectively aligned with, and are in effect continuations of the slot edges 16*a*, 16*a'*, on any partition and, as illustrated in FIG. 4, the tab 22 of the interlocked cross-partition 14 will overlap and is retained in position by the edge 23*b'* of the partition 13 when the divider 12 is collapsed in the direction shown. It will be noted that any pivoting or sliding movement of one partition with respect to the other as would permit the partitions to disengage while the divider is in its collapsed condition is substantially prevented by such overlapping of the tabs 22, 22' with the tab retainer edges 23b', 23b which occurs on the same side of the collapsed divider.

The rigidity of the divider 12 in its opened condition as shown in FIG. 3 is enhanced by a cross-partition support tab 24 (or 24') which projects only part way across the width of the slot 16 (or 16') from the side edge 16b (or 16b') of the slot at its open end 16c (or 16c'). That is, the distance of projection is such that its outermost edge portion 24a (or 24a') firmly retains the cross-partition surface area 17 (or 17') against the first edge 16a (or 16a') of the slot, considering that another portion of the cross-partition towards its other end is restrained in the same direction by the engagement interface between the respective closed ends 16d (or 16d') of the engaged slots, and by the engagement of the tabs 22 (or 22') with edges 23b' (or 23b) of the respective tab-receiving openings 23' (or 23).

The present invention contributes significantly to the reliability and rigidity of this restraint at the closed ends 16d (or 16d') of the slots 16, 16'. That is, and with reference to any of FIGS. 5, 6 or 7, each slot 16 (or 16', though not illustrated in these Figures) has an arcuate portion 16g, opposite the tab 22, which as it meets the slot closed end 16d passes through a point of inflection to a reverse radius, preferably a radius of about ⅛", providing a reversed arcuate portion 30 which ultimately meets the closed end 16d in a direction parallel to the axis of the slot and spaced laterally away from the line projection of the opposite slot edge portion 16h a distance d which is only equal to the thickness t (FIG. 2) of the intersecting partition. Because this thickness t, and therefore the distance d, is ordinarily very small (e.g., about 0.040"), in order for this arrangement to be manufacturable, an edge relief 16x is cut from the slot edge 16h to permit the arcuate portion 30 to be sharply formed. The particular depth or length of this cutout 16x is not critical, so long as some portion of the length of the slot edge portion 16h remains.

Thus, when a cross-partition is interlocked, the edge portion 30 urges the surface portion 26' of the interlocked partition firmly against the slot edge portion 16h, both in the erected and collapsed conditions of the divider. It will be recalled that the tab support edge portion 24a also urges the interlocked partition in the same direction as does the arcuate portion 30, and the interlocked partition is therefore held at two spaced apart locations against an opposite edge portion of the slot, so that movement of the partitions apart, in a direction transverse to the axis of the slot, is inhibited, thus enhancing the efficacy of the interfacing pairs of abutment edges 22a, 23a'; 22b, 23f'; and 16d, 16d'. In the embodiment as illustrated in FIGS. 5 and 6, this opposite slot edge portion preferably includes the slot edge length 16a. However, and as will be explained, in the modified form of the invention illustrated in FIG. 7 in which the slot edge portion 16a'' is not vertical, this opposite edge portion may only be the slot edge portion 16h, against which the arcuate portion 30 also urges the intersecting partition.

Although the slot width can be narrower to approximately equal the partition thickness t, for convenience in cutting during manufacture each slot 16, 16' is made wider than the thickness t of any partition. This relatively wide slot permits the partition to slide easily together during assembly, and also accommodates the momentary angular disposition of one partition 13 with respect to the other partition 14 which takes place as they are being assembled, as the tab 22' of the partition 13, in effect, "rides over" the tab 22 of the partition 14, as illustrated in FIG. 5. That is, as the slot of the partition 13 is moved into engagement with the oppositely facing slot of the partition 14 (or vice versa), first its support tab 24' and then its locking tab 22', and finally its surface portion 26' between the closed end 16b' of its slot and the edge 23a' of its tab-receiving opening 23', sequentially ride up the sloping edge 22b of the tab 22 on the partition 14, as indicated by a comparison of FIGS. 5 and 6. During such movement the partition 13 pivots in the direction of the arrow G in FIG. 5. Of course, because its corresponding elements must also "ride over" the tab 22' on the partition 13, the partition 14 will also assume an angular disposition with respect to the partition 13, but in a direction displaced 90° with respect to the direction of the first mentioned angular disposition between the same partitions. Thus, the relatively wide slots 16 and 16' minimize bending and possible distortion of the partitions, and cause them to slide together more readily as in an automatic assembling machine. In addition, the slot edge 16a, 16b' is chamfered, as at 25 (or 25'), at the open end 16c, 16c' of the slot 16, 16' opposite to the cross-partition support tab 24, 24', and a gently sloping edge portion 16f is preferably provided, to further minimize bending of the other partition during assembly.

As indicated in FIG. 6, the location of the open portion 23c (or 23c') of the tab-receiving opening 23 (or 23'), on the side thereof opposite the edge 23b, (or 23b') and which initially receives the locking tab 22' (or 22) of the cross-partition as the two are moved together, is determined by the momentary maximum angular relationship between the partitions as illustrated by dotted lines in FIG. 6. This location of the open portion 23c corresponds with the location of the tab 22' of the partition which is being interlocked therewith as it arrives at such maximum angular disposition. Of course the width of the open portion 23c is sufficient to accommodate at least the length of the peak edge 22c' of the saw-tooth shaped tab 22' on the other partition.

Some flexing of both partitions 13 and 14 will occur as they move into interlocking engagement. Thus, the sizing and relationships of the comating elements is a compromise between the amount of such flexing as can be tolerated during a high-speed assembly operation and the desire to achieve a close "snap in" fit as the partitions attain their fully interlocked relationship.

Thus, with reference to FIG. 6, the innermost corner 25a (or 25a') of the chamfered edge 25 (or 25') is substantially aligned with the tab peak edge 22c (or 22c') and the slot corner edge 16e (or 16e'), the latter being defined by the juncture between the slot edge 16b (or 16b') and the slope portion 16f (or 16f') of the same slot edge.

The arcuate edge 16g (or 16g') which extends from the inner end of the slope portion 16f (or 16f') to the closed end 16d (or 16d') of the slot 16 (or 16') is faired in spaced relation around the tab 22 (or 22') including its peak edge 22c (or 22c) so that slot width is maintained, and so that the arcuate portion 16g (or 16g') guides the slot closed end 16d' (or 16d) of the other partition into abutting relationship with its slot closed end 16d (or 16d') as the surface portion 26' (or 26) of the other partition "rides off" the tab 22 during the assembly. In other words, the arc of the portion 16g approximates the locus of imaginary points generated by the slot closed end 16d' of the other partition during the movement of the other partition in the direction of arrow H in FIG. 6 beyond its maximum angular disposition indicated by dashed lines in that Figure.

When the partitions 13 and 14 are fully interlocked as indicated by the full line showing in FIG. 6, the surface portion 26' (or 26) of one partition lies against the second straight edge portion **16*h* (or 16*h'*) of the other (i.e., the portion 26' of partition 13 lies against slot edge portion 16*h* of partition 14 in FIG. 6), the distance between the abutment edge 22*a* of the tab 22 and the closed end 16*d* of the slot being substantially equal to the length of the portion 26 (or 26') between the slot closed end 16*d* (or 16*d'*) and the abutment edge 23*a* (or 23*a'*) of the tab-receiving opening 23 (or 23'). As will be noted, the slot edge portion 16*h* (or 16*h'*) is aligned with the slot edge 16*a* (or 16*a'*) and with the tab retainer edge 23*b* (or 23*b'*) of the tab-receiving opening 23 (or 23'**).

For the same reasons, and although they may be made straight, the configurations of the opposite side edges **23*d* and 23*e* of the somewhat triangular-shaped tab-receiving opening preferably are curved to substantially correspond with the locus of imaginary points generated by the abutment edge 22*a'* of the tab 22' and by its opposite sloping edge 22*b'* as the tab 22' on the other partition moves, in the direction of arrow H in FIG. 6, within the tab-receiving opening 23** during assembly.

It will further be noted that the length of the tab-retainer edge **23*b* is substantially equal to the length of the tab 22*a* between its abutment-edge 22*a'* and the foot end 22*d'* of its sloping edge 22*b'***.

Thus, when any two cross-partitions 13 and 14 are assembled, they are rigidly interlocked by the close-fit of their parts as well as by their described features, when the assembled divider is both in its opened condition and in its collapsed condition. The interlock is retained in both directions along the imaginary line 17, 17' of their conjuncture by the pair of oppositely directed abutment interfaces formed between the two partitions by the respective abutments between the tab abutment-edges **22*a*, 22*a'* and the tab-receiving opening abutment edges 23*a*, 23*a'* of each partition, as perhaps best seen in FIG. 6. The interlock is further enhanced by the third abutment interface provided by the abutting engagement of their slot closed ends 16*d*, 16*d'*, and by the abutting fit of a fourth abutment edge 23*f* provided by the tab-receiving opening 23, also seen in FIG. 6**.

The modified embodiment of the invention illustrated in FIG. 7 shows that the opposite side edges **16*a''* and 16*b''* of the slot 16 need not be parallel and, in fact, may taper towards each other in the inward direction of the partition 31. It will be noted, however, that the slope of the slot edge 16*a''* is such that a point 16*d''* therealong, which is spaced from the tab-abutment edge 22*a* a distance equal to the length of the tab-receiving opening edge 23*b*, will abut the abutment edge 23*f'* of the tab opening of the interlocking partition. Such suggests that, in the previously described embodiment of FIGS. 5 and 6, the interlocking partition need not be supported by the slot side wall portion 16*a*, so long as the abutment edge 23*f* of the interlocking partition abuts a similar point location along the sloping edge 22*b* of the locking tab 22, in which case the edge portion 16*a* may not be in alignment with the edge portion 16*h***.

FIG. 7 also shows that the partition support tab 24'', and thus its edge portion **24*a''*, may be located inwardly along the length of the slot edge 16*b''*, and that a reverse curve 24*b''* may be provided at its end which conjoins the partition edge 18. Moreover, its edge portion 24*a''* need only be in alignment with the support edge 30 at the bottom 16*d* of the slot, and need not be disposed with any particular spacing distance from the slot edge 16*a''***.

The construction illustrated in FIG. 7 is particularly useful when making "low-height" partitions, such as about 4" high.

Further, it should be noted that, although in the preferred embodiment and in the illustrated alternate embodiment of FIG. 7 the slot end **16*d* (or 16*d'* or 16*d''*) is located at the center of the width of the partition so that the corresponding partition edges 18, 19 (or 18', 19' or 18'', 19'') of the assembled divider are within the same plane, the slot closed end 16*d* (or 16*d'* or 16*d''*), the tab 22 (or 22' or 22''), and the tab-receiving opening 23 (or 23' or 23'') may be relocated nearest to either of the partition edges 18 or 19 (or 18', 18'', 19' or 19''), preferably towards the edge 18 (or 18' or 18''**), where in the assembled carton divider the top and bottom edges of the longitudinal and transverse partitions are not intended to lie within the same respective planes. It will also be understood that, so long as the slot configurations of the interlocking partitions coincide, the height of either of the two partitions may be less than that of the other, if desired.

Referring again to FIGS. 3 and 4, adjacent to the end edges 20, 20' of both the transverse and the longitudinal partitions 13, 14 there is an opening 27, 27' which may be circular as shown, or of other shape, to assist in identifying the proper direction in which to collapse the divider 12 from its erect condition as shown in FIG. 3 to its correctly collapsed condition as shown in FIG. 4 in which the locking tabs 22, 22' appear on the same side of the divider. As seen in FIG. 4, when the divider is properly collapsed, the identification indicia 27, 27' all face or point in a common direction.

If the divider 12 were to be collapsed in the opposite direction (not illustrated), i.e., in the direction opposite to arrows B in FIG. 3, the tabs 22, 22' would not overlap the tab retainer edges **23*b*, 23*b'* of the tab-receiving openings 23, 23' and the divider would not be rigidly interlocked in such collapsed condition. In fact, the partitions 13 and 14 would separate fairly eaasily, and such suggests that the divider 12** can be easily disassembled, should such become necessary for any reason, simply by collapsing the divider in the direction opposite to arrows B and then separating the partitions.

Alternative direction-identifying indicia are shown in FIG. 2 by reference numerals 31 on partitions 14 and 31' on partitions 13, these being square-shaped, or any other distinctively shaped corner cutout portions at the conjunction of only one of the commonly facing ends 21 (partition 14) and 20' (partition 13) of each partition with the respective of the partition bottom edges 19 and 19'. Of course, alternatively, the corner cutouts might be at the respective of the partition top edges 18, 18', instead of at their bottom edges 19 and 19'. In any event, such corner cutouts are visible when the collapsed dividers are stacked, so that any one in the stack which is collapsed incorrectly in the wrong direction is readily identifiable. In addition, such corner cutouts facilitate the proper orienting of the correctly collapsed dividers as they are loaded into a partition erection machine for erection and placement in a carton.

Thus has been described a divider for inserting into a bottle-carrier carton, and the partitions from which such carton divider is assembled, which achieves all of the objects of the invention.

What is claimed is:

1. A collapsible carton divider having at least one substantially planar partition and one substantially planar cross-partition interlocked therewith along an imaginary line of intersection between their respective planes, each said partition and cross-partition having parallel and opposite first and second edges and partition interlock means for interlocking with each partition which interlocks therewith, each said partition interlock means comprising means defining an open-ended slot having opposite side edges extending inwardly from said first edge of the partition and spaced apart a distance which is substantially greater than the thickness of the partition and a closed-end thereof located intermediate said first and second edges of the partition, a surface portion aligned with said slot and which determines, and extends beyond, said closed end of the slot towards said second edge of the partition, means defining a locking tab projecting from one of said side edges of said slot and providing a first abutment edge facing away from the open end of said slot, a portion of said one side edge of the slot being disposed between said locking tab first abutment edge and said closed end of the slot, means defining a tab-receiving opening within said surface portion and providing a second abutment edge facing away from the open end of said slot, said surface portion between said slot and said tab-receiving opening on each of said interlocked partitions being received in said slot of its interlocked partition, and said locking tab on each of said interlocked partitions being received in said tab-receiving opening of its interlocked partition with said first abutment edges respectively abutting said second abutment edges on the respective of said interlocked partitions, said closed end of each partition slot being disposed at a location which is midway between said first and second abutment edges of the partition, the respective of said closed ends of the slots of said interlocked partitions being in abutting engagement with each other thereby together defining another abutment edge interface between each said partition and its interlocked partition, and said tab-receiving opening of each said partition further providing a tab-retainer edge aligned with said portion of said one side edge of said slot, the distance of projection of said locking tab on each of said partitions being substantially greater than the thickness of the partition whereby said locking tabs overlap the respective of said tab-retainer edges of said tab-receiving openings with which said locking tabs are respectively associated, the other side edge of said partition slot including a substantially arcuate length portion spaced laterally away from said locking tab and extending substantially to the closed end of said partition slot, said arcuate length portion including a holding edge portion closely adjacent to said slot closed end and spaced laterally away from the line of projection of said portion of said one side edge of said slot by a distance which is substantially equal to the thickness of its associated interlocked partition to support its said interlocked partition therebetween, each said partition and cross-partition interlock means further comprising a partition support tab projecting from said other side edge of said slot substantially adjacent to said open end of the slot, said partition support tab projecting into said slot to a location aligned, in the direction of said slot, with said holding edge portion adjacent to said slot closed end, whereby its said interlocked partition is urged towards said portion of said one side edge of said slot, by both said partition support tab and said holding edge portion, said partition surface portion between said tab-receiving opening and said second side edge of each said partition and cross-partition engaging said one side edge of said slot of its interlocked partition at a location between said locking tab of the partition and said open end of the slot, each said partition slot further including means defining a cut-out portion of said slot extending between said portion of said one side edge of said slot and said slot closed end, said cut-out portion being adjacent to said slot closed end and located opposite to said holding edge portion on said other side edge of the partition slot.

2. A carton divider according to claim 1, wherein each said holding edge portion is a reversely curved portion of its said associated arcuate length portion of said other side edge of said slot, that portion of said reversely curved portion which is immediately adjacent to said slot closed end being parallel to said line of projection of said portion of said one side edge of said slot.

3. A carton divider according to claim 1 or claim 2, wherein said cut-out portion includes a straight portion extending perpendicular to said line of projection of said one side edge of said slot and coinciding with said closed end of said slot.

4. A carton divider according to claim 1, wherein said second abutment edge within the tab-receiving opening of each said partition and cross-partition is a straight portion extending perpendicularly from said tab-retainer edge a distance substantially equal to the thickness of its interlocked partition.

5. A carton divider according to claim 4, wherein said tab-receiving opening of each said partition and cross-partition includes an additional abutment edge in alignment with and facing towards said second abutment edge, said additional abutment edge engaging said locking tab of its interlocked partition.

6. A carton divider according to claim 1 or claim 2, wherein said opposite side edges of said slot of each said partition and cross-partition are angularly disposed with respect to each other along their lenghts extending from substantially adjacent to the open end of the slot to said locking tab whereby the width of each slot narrows towards said locking tab, and said tab-receiving opening includes an additional abutment edge in alignment with and facing towards said second abutment edge, said additional abutment edge engaging said locking tab of its interlocked partition.

7. A planar partition for assembling with at least one similar partition to make a carton divider, said partition having parallel and opposite first and second edges and partition interlock means for interlocking with each partition which interlocks therewith, each said partition interlock means comprising means defining an open-ended slot having opposite side edges extending inwardly from said first edge of the partition and spaced apart a distance which is substantially greater than the thickness of the partition and a closed-end thereof located intermediate said first and second edges of the partition, a surface portion aligned with said slot and which determines, and extends beyond, said closed end of the slot towards said second edge of the partition, means defining a locking tab projecting from one of said side edges of said slot and providing a first abutment edge facing away from the open end of said slot, a portion of said one side edge of the slot being disposed between said locking tab first abutment edge and said closed end of the slot, and means defining a tab-receiving opening within said surface portion and providing a second abutment edge facing away from the open end of said slot, and a tab-retainer edge aligned with said portion of said one side edge of said slot, said closed end of said slot being disposed at a location which is midway between said first and second abutment edges of the partition, the distance of projection of said locking tab being substantially greater than the thickness of the partition, the other side edge of said partition slot including a substantially arcuate length portion spaced laterally away from said locking tab and extending substantially to the closed end of said partition slot, said arcuate length portion including a holding edge portion closely adjacent to said slot closed end and spaced laterally away from the line of projection of said portion of said one side edge of said slot by a distance which is substantially equal to the thickness of said partition, each said partition interlock means further comprising a partition support tab projecting from said other side edge of said slot substantially adjacent to said open end of the slot, said partition support tab projecting into said slot to a location aligned, in the direction of said slot, with said holding edge portion adjacent to said slot closed end, said partition slot further including means defining a cutout portion of said slot extending between said portion of said one side edge of said slot and said slot closed end, said cutout portion being adjacent to said slot closed end and located opposite to said holding edge portion on said other side edge of the partition slot.

8. A partition according to claim 7, wherein said holding edge portion is a reversely curved portion of said arcuate length portion of said other side edge of said slot, that portion of said reversely curved portion which is immediately adjacent to said slot closed end being parallel to said line of projection of said portion of said one side edge of said slot.

9. A partition according to claim 7 or claim 8, wherein said cut out portion includes a straight portion extending perpendicular to said line of projection of said one side edge of said slot and coinciding with said closed end of said slot.

10. A partition according to claim 7, wherein said second abutment edge within said tab-receiving opening is a straight portion extending perpendicularly from said tab-retainer edge a distance substantially equal to the thickness of said partition.

11. A partition according to claim 10, wherein said tab-receiving opening includes an additional abutment edge in alignment with and facing towards said second abutment edge for engaging said locking tab of an interlocked partition.

12. A partition according to claim 7 or claim 8, wherein said opposite side edges of said slot are angularly disposed with respect to each other along their lengths extending from substantially adjacent to the open end of the slot to said locking tab whereby the width of the slot narrows towards said locking tab, said tab-receiving opening includes an additional abutment edge in alignment with and facing toward said second abutment edge for engaging said locking tab of an interlocked partition.

* * * * *